US009323275B2

(12) United States Patent
Marinca

(10) Patent No.: US 9,323,275 B2
(45) Date of Patent: Apr. 26, 2016

(54) PROPORTIONAL TO ABSOLUTE TEMPERATURE CIRCUIT

(71) Applicant: Stefan Marinca, Limerick (IE)

(72) Inventor: Stefan Marinca, Limerick (IE)

(73) Assignee: ANALOG DEVICES GLOBAL, Hamilton (BM)

( * ) Notice: Subject to any disclaimer, the term of this patent is extended or adjusted under 35 U.S.C. 154(b) by 195 days.

(21) Appl. No.: 14/103,220

(22) Filed: Dec. 11, 2013

(65) Prior Publication Data

US 2015/0160680 A1 Jun. 11, 2015

(51) Int. Cl.
*G05F 3/30* (2006.01)

(52) U.S. Cl.
CPC ..... *G05F 3/30* (2013.01)

(58) Field of Classification Search
CPC ..... G05F 3/30; G05F 3/262; G05F 3/247; G05F 3/265; G05F 3/245
USPC ..... 323/312, 313, 315, 316, 907
See application file for complete search history.

(56) References Cited

U.S. PATENT DOCUMENTS 5,448,158 A * 9/1995 Ryat ..... G05F 3/267 323/312
5,469,111 A 11/1995 Chiu
5,519,354 A 5/1996 Audy
5,604,427 A * 2/1997 Kimura ..... G05F 3/30 323/313
5,646,518 A * 7/1997 Lakshmikumar ..... G05F 3/267 323/316
6,181,121 B1 1/2001 Kirkland et al.
7,863,882 B2 1/2011 Harvey
8,228,052 B2 7/2012 Marinca
2005/0285666 A1* 12/2005 Garlapati ..... G05F 3/267 327/539
2006/0001412 A1* 1/2006 Fernald ..... G05F 3/262 323/313
2006/0103455 A1 5/2006 Zhang et al.
2008/0265860 A1 10/2008 Dempsey et al.
2009/0039949 A1 2/2009 Pietrobon
2015/0177771 A1* 6/2015 Marinca ..... G05F 3/185 323/313
2015/0234414 A1* 8/2015 Marinca ..... G05F 3/30 323/313

FOREIGN PATENT DOCUMENTS

CN 1949122 A 4/2007
CN 101561688 A 10/2009
CN 102081423 A 6/2011
CN 102122190 A 7/2011
CN 103135656 A 6/2013

* cited by examiner

*Primary Examiner* — Adolf Berhane
(74) *Attorney, Agent, or Firm* — Kenyon & Kenyon LLP

(57) ABSTRACT

A proportional to absolute temperature, PTAT, circuit is provided. By judiciously combining circuit elements it is possible to generate a voltage at an output node of the circuit that is temperature dependent. Such a PTAT circuit can be used as a temperature sensor or can be combined with other temperature dependent circuits to provide a voltage reference.

22 Claims, 13 Drawing Sheets

PROPORTIONAL TO ABSOLUTE TEMPERATURE CIRCUIT

FIELD

The present disclosure relates to a method and apparatus for generating an output that is temperature dependent. More particularly the present disclosure relates to a methodology and circuitry configured to provide an output signal that is proportional to absolute temperature. Such an output signal can be used in temperature sensors, bandgap type voltage references and different analog circuits

BACKGROUND

It is well known that temperature affects the performance of electrical circuitry. The resistance or conductivity of electrical components varies dependent on the temperature of the environment within which they are operating. Such understanding can be used to generate circuits or sensors whose output varies with temperature and as such function as temperature sensors. The output of such circuits can be a proportional to absolute temperature, PTAT, output or can be a complimentary to absolute temperature, CTAT, output. A PTAT circuit will provide an output that increases with increases in temperature whereas a CTAT circuit will provide an output that decreases with increases in temperature.

PTAT and CTAT circuits are widely used in temperature sensors, bandgap type voltage references and different analog circuits. A voltage which is proportional to absolute temperature (PTAT) may be obtained from the base-emitter voltage difference of two bipolar transistors operating at different collector current densities. A corresponding PTAT current can be generated by reflecting the base-emitter voltage difference across a resistor. With a second resistor of the same type and having the same or similar temperature coefficient (TC), the base-emitter voltage difference can be gained to the desired level.

These known circuits can suffer from mismatch arising from the currents that are used to bias the component bipolar transistors that are used to generate the PTAT voltage.

SUMMARY

These and other problems are addressed a proportional to absolute temperature, PTAT, circuit provided in accordance with the present teaching. By judiciously combining circuit elements it is possible to generate a voltage at an output node of the circuit that is temperature dependent. The circuit elements are coupled to a single biasing current. Desirably, the circuit elements comprise bipolar transistors and by avoiding the need for a second current source to drive the bipolar transistors of the PTAT circuit the present teaching avoids the problems associated with mismatch. Such a PTAT circuit can be used as a temperature sensor or can be combined with other temperature dependent circuits to provide a voltage reference.

BRIEF DESCRIPTION OF THE DRAWINGS

Embodiments which are provided to assist with an understanding of the present teaching will now be described, by way of example, with reference to the accompanying drawings, in which.

Figure 6:
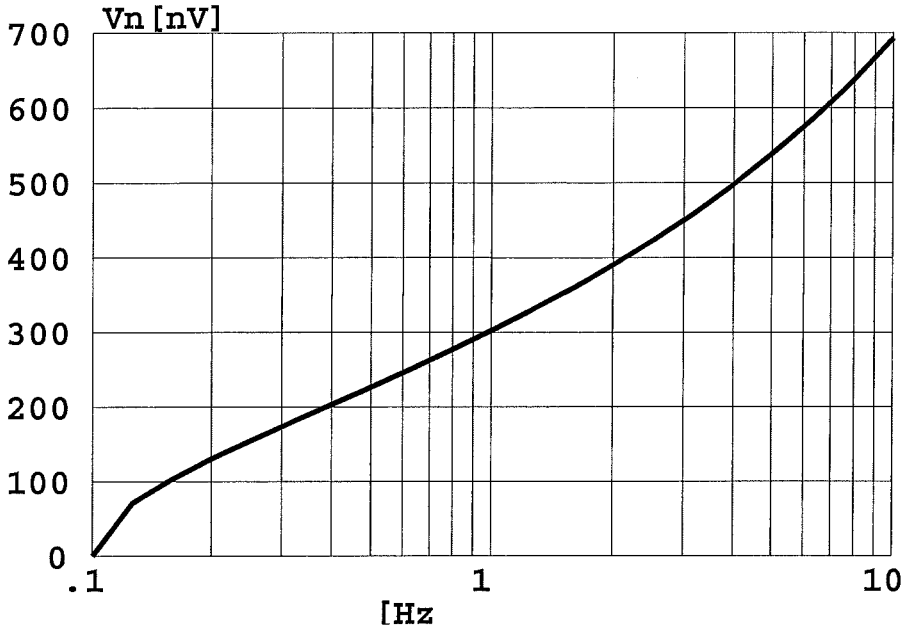
Figure 7:
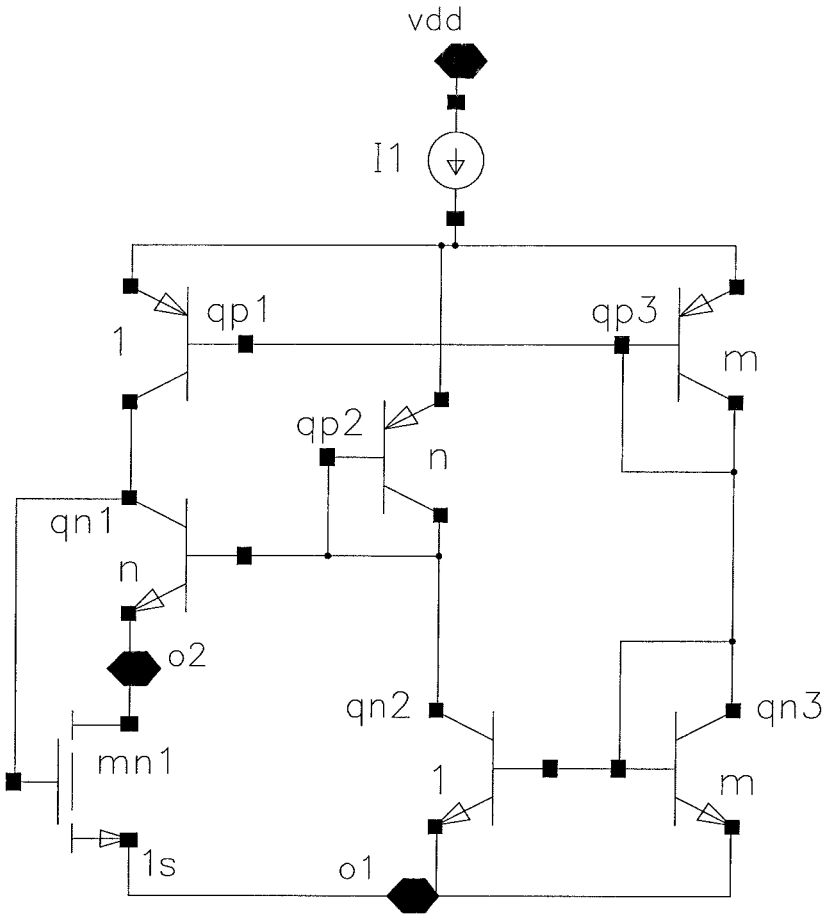
Figure 8:
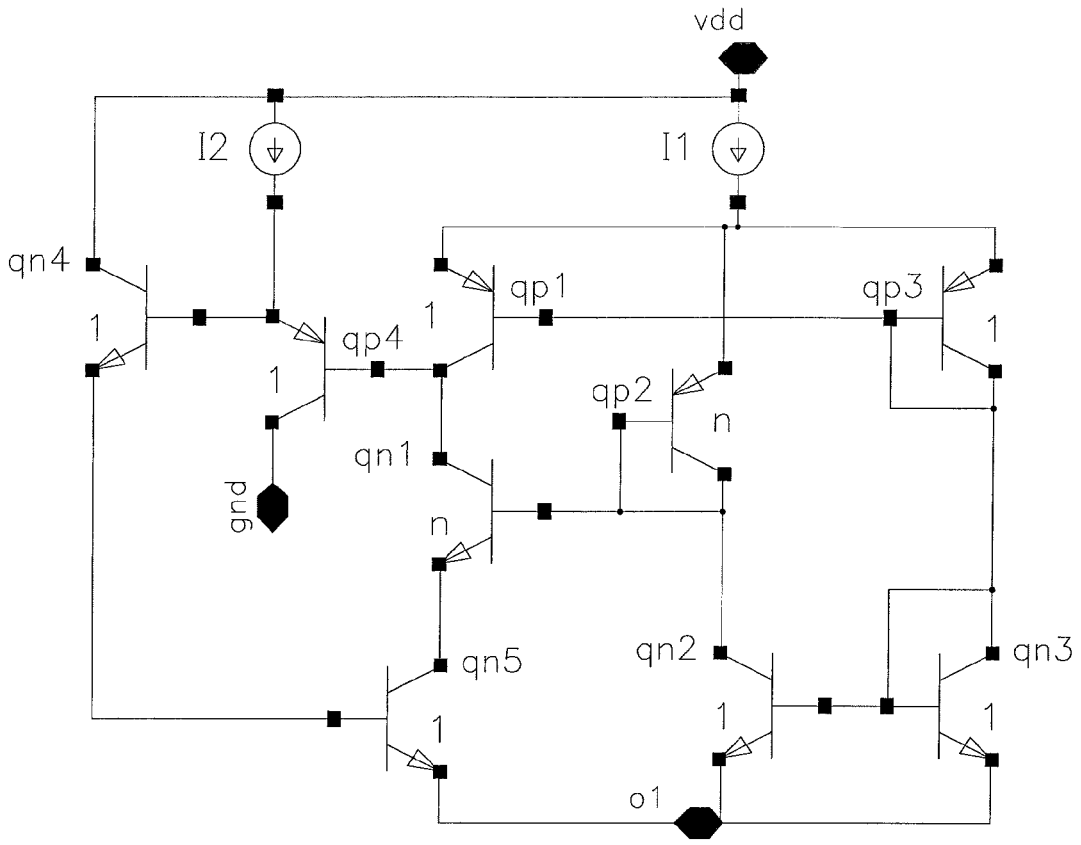
Figure 9:
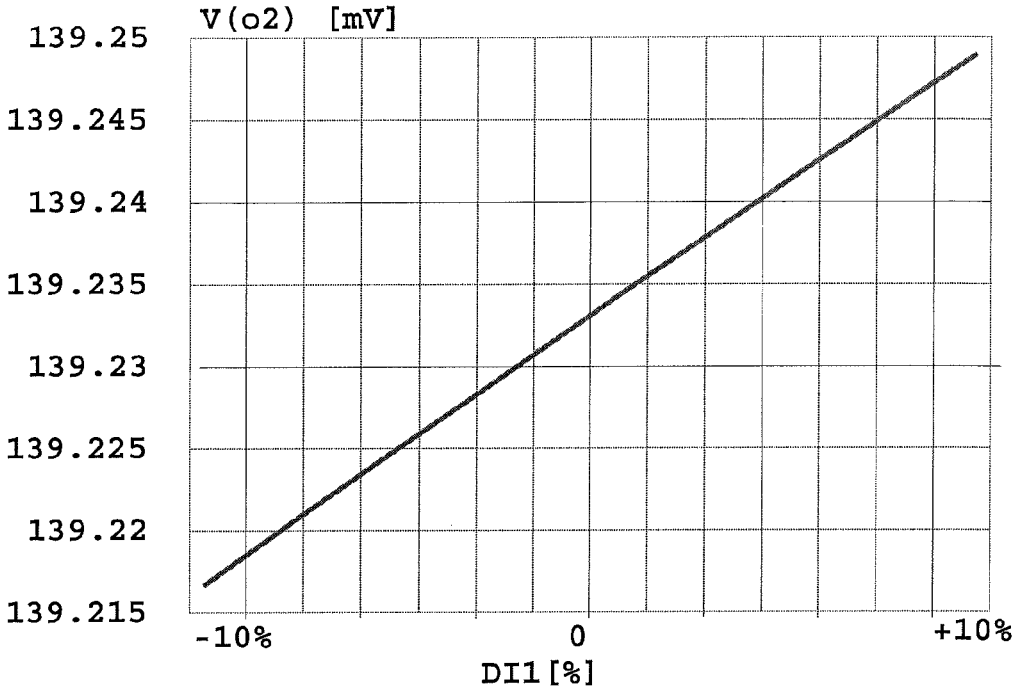
Figure 10:
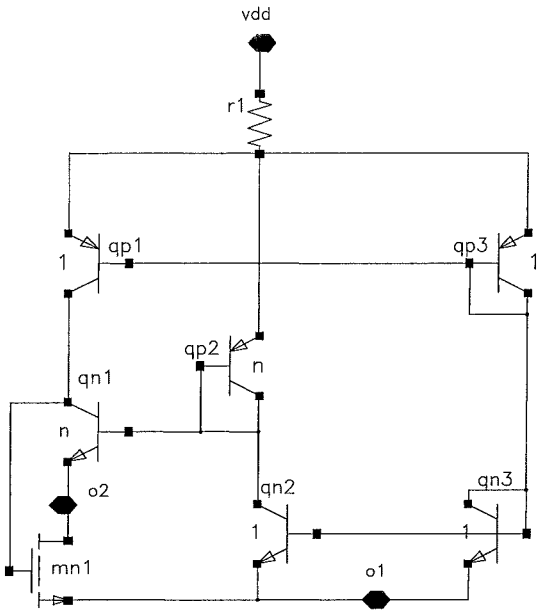
Figure 11:
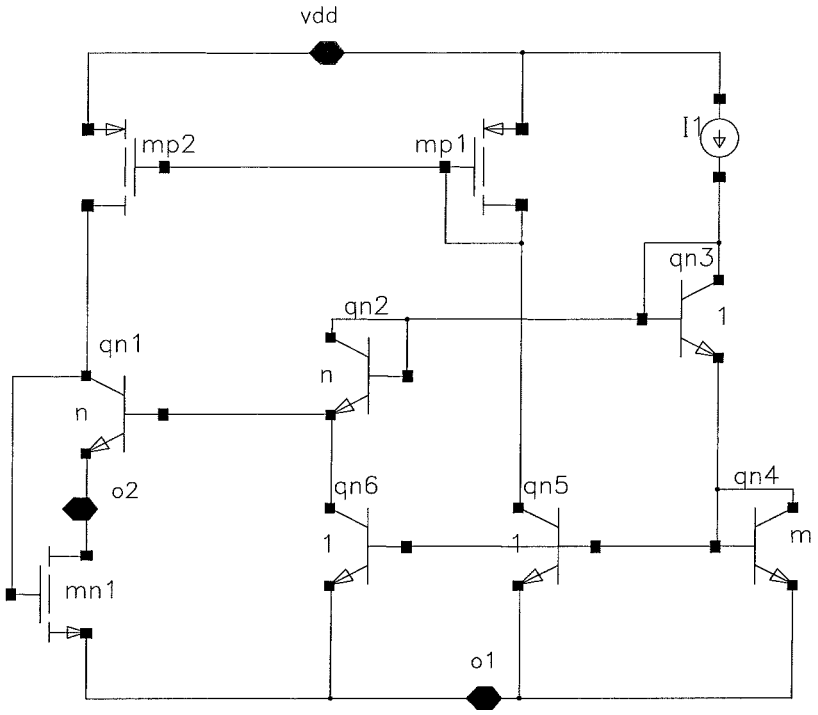
Figure 12:
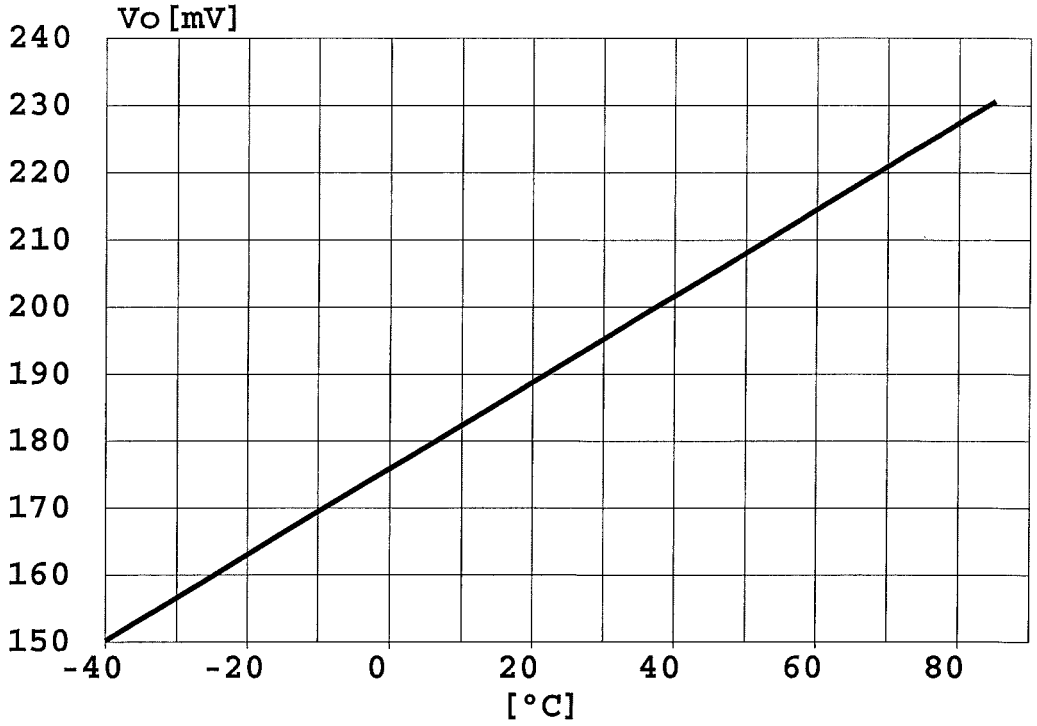
Figure 13:
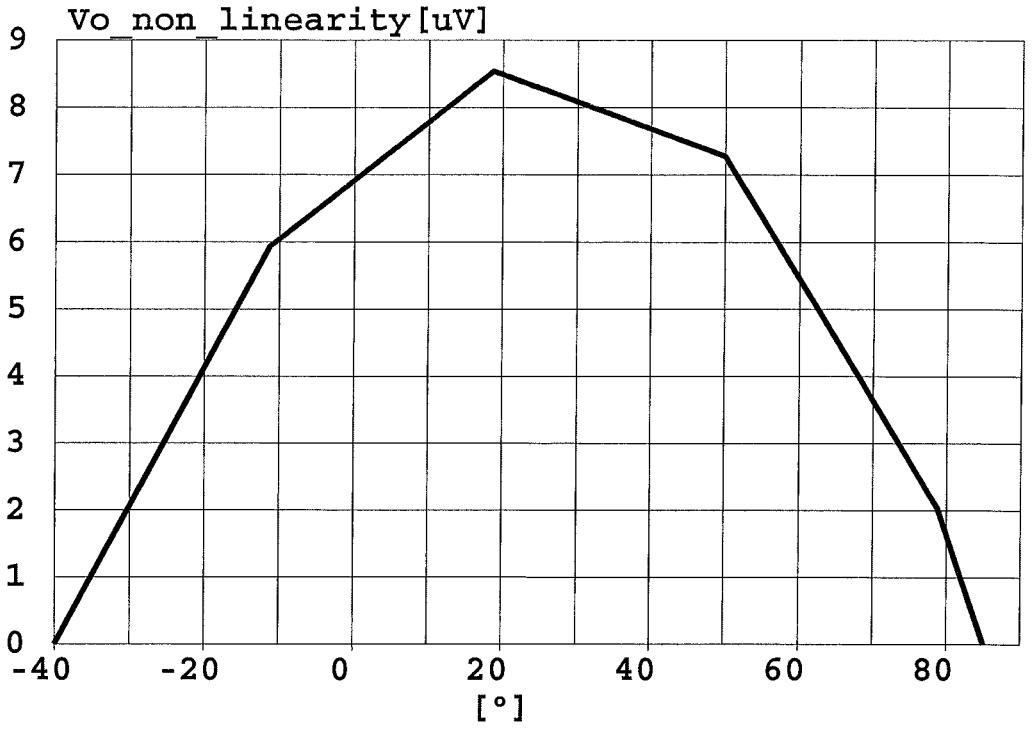
Figure 14:
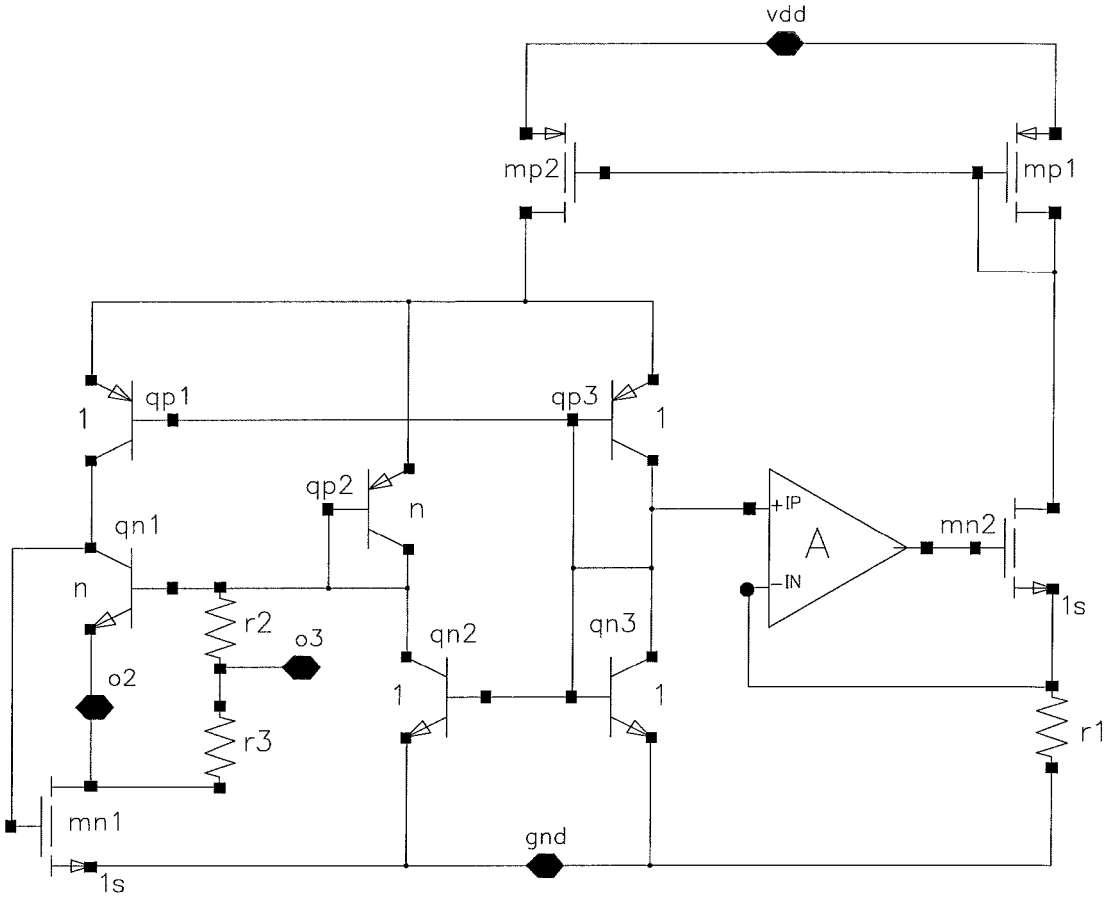
Figure 15:
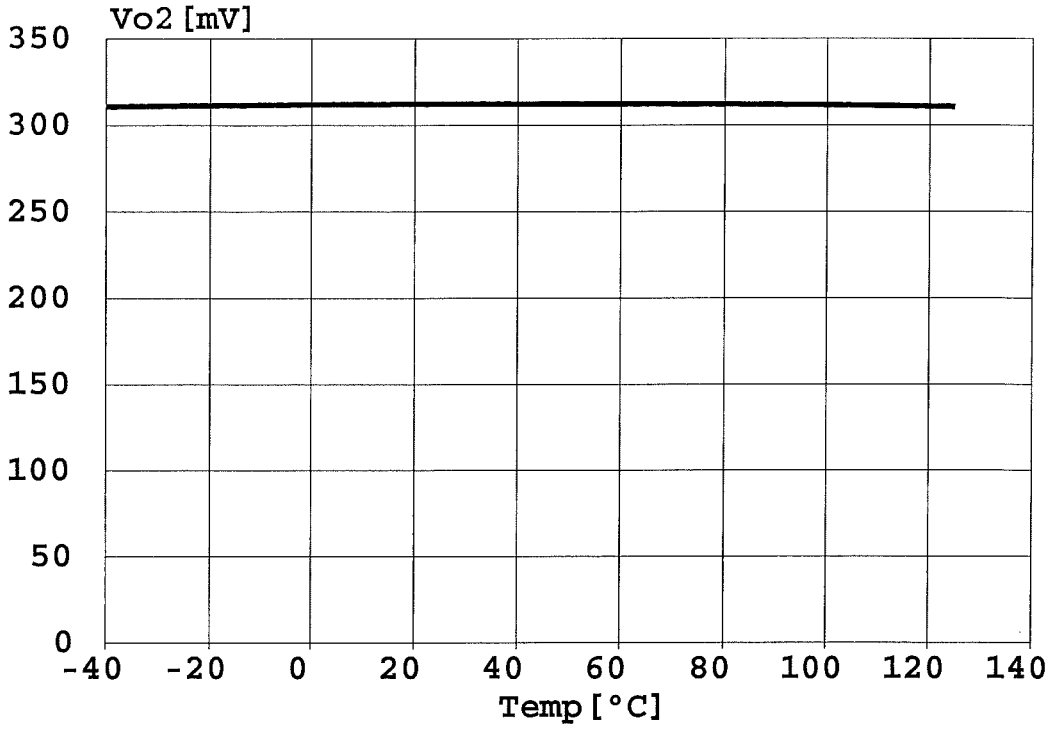

at 25° C. from 0.1 Hz to 10 Hz;

FIG. 6 is a graph showing simulation data of the corresponding integrated voltage noise from 0.1 Hz to 10 Hz;

FIG. 7 is a schematic showing components of an illustrative circuit provided in accordance with the present teaching;

FIG. 8 is a schematic showing components of an illustrative circuit provided in accordance with the present teaching;

FIG. 9 is a graph showing simulation data of the performance of a circuit per the teaching of FIG. 8;

FIG. 10 is a schematic showing components of an illustrative circuit provided in accordance with the present teaching;

FIG. 11 is a schematic showing components of an illustrative circuit provided in accordance with the present teaching;

FIG. 12 is a graph showing simulation data of the output voltage verses temperature of a circuit per the teaching of FIG. 11;

FIG. 13 is a graph showing simulation data of the output voltage verses its nonlinearity of a circuit per the teaching of FIG. 11;

FIG. 14 is an example of a circuit provided in accordance with the present teaching incorporating PTAT and CTAT component cells to generate a temperature compensated output voltage; and FIG. 15 is a graph showing a simulated voltage output verses temperature for the circuit of FIG. 14.

DETAILED DESCRIPTION

The present teaching provides a proportional to absolute temperature, PTAT, circuit which is configured to generate a voltage at an output node of the circuit that is temperature dependent. The circuit comprises a plurality of circuit elements that are coupled to a single biasing current. Desirably, the circuit elements comprise bipolar transistors and by avoiding the need for a second current source to drive the bipolar transistors of the PTAT circuit, the present teaching avoids the problems associated with mismatch. Individual ones of the circuit elements are grouped into arms of the circuit and the single biasing current is divided between the arms. In this way the circuit elements of a first arm can compensate for performance of circuit elements in a second arm such that a self-compensating circuit is provided. Such a PTAT circuit can be used as a temperature sensor or can be combined with other temperature dependent circuits to provide a voltage reference.

Figure 1:
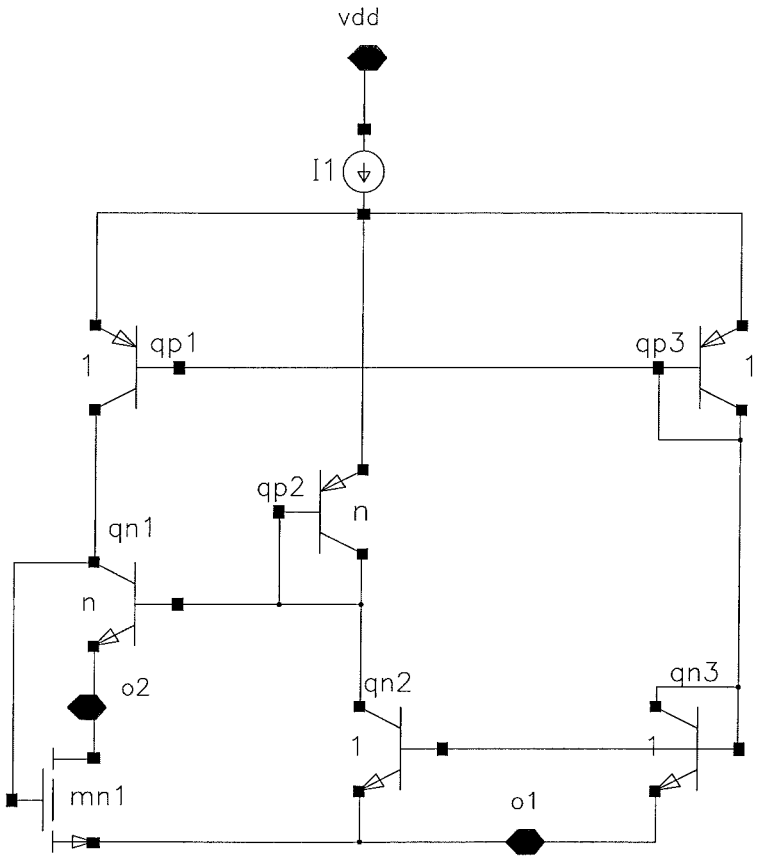
FIG. 1 is a schematic showing components of an illustrative circuit provided in accordance with the present teaching.

The present teaching will now be described with reference to exemplary arrangements. As shown in FIG. 1 the present teaching provides a proportional to absolute temperature (PTAT) circuit which is configured to provide a PTAT voltage at an output thereof. The circuit comprises a plurality of circuit elements, shown as bipolar transistors, which are arranged relative to one another such that the voltage provided at an output node o2 is dependent on the emitter ratio between the individual transistors.

The circuit is arranged into three arms. In a first arm a first PNP bipolar transistor qp1 is coupled to a first NPN bipolar transistor qn1, and to a first MOS device mn1. A second arm of the circuit comprises a second PNP bipolar transistor qp2 and a second NPN bipolar transistor qn2. A third arm of the circuit comprises a third PNP transistor qp3 and a third NPN transistor qn3. Each of the three arms is coupled to a single current source I1. The source is arranged relative to the three arms such that the bias current provided by the source is divided down each of the three arms as three equal currents. This is advantageously achieved by tying the emitters of each of the three PNP transistors to a common node which is biased by the same bias current I1.

Two of the PNP bipolar transistors qp1 and qp3 are selected to have unity emitter size. In a similar fashion two of the NPN bipolar transistors qn2 and qn3 are selected having unity emitter size. The second PNP bipolar transistor, qp2, and the second NPN bipolar transistor, qn1, are selected to have 'n' times unity emitter area.

The third PNP transistor, qp3, is provided in a diode configuration with its base coupled to the collector. In a similar fashion the third NPN transistor, qn3, is provided in a diode configuration. Each of these two transistors, qn3, qp3, are commonly coupled.

The base of the second NPN transistor, qn2, is coupled to the common base/collector of the third NPN transistor. The collector of this NPN transistor, qn2, is coupled to the diode configured second PNP transistor, qp2. This common node is then also coupled to the base of the first NPN transistor, qn1. This first NPN transistor, qn1, is also coupled to the first MOS device mn1.

In this way a base-emitter voltage difference generated from the ratio of the two bipolar transistors operating at a higher collector current density, qp3 and qn3, to that of the two bipolar transistors of a low collector current density, qp2 and qn1, is reflected across the MOS device, mn1. This base-emitter voltage difference is:

$$V_{02} - V_{01} = V_{be}(qp3) + V_{be}(qn3) - V_{be}(qp2) - V_{be}(qn1) = 2 * \frac{kT}{q} * \ln(n) \quad (1)$$

The difference in emitter area can be different for each of the NPN bipolar transistors and PNP bipolar transistors.

As can be seen from Eq. 1 the output voltage difference, $V_{o2}-V_{o1}$, is obtained from the base-emitter voltage difference of bipolar transistors operating at different collector current densities and is therefore PTAT voltage. This PTAT voltage is, at the first order, independent of the bias current I1. This voltage depends only on the emitter area ratio, n.

The circuit of FIG. 1 exhibits very little sensitivity to mismatch arising from differences in the devices used in the circuit. In an ideal situation with each of unity emitter area NPN devices being identical and each of the unity emitter area PNP devices being identical, then the current in each of the three arms can be considered the total bias current I1/3.

It will be understood that there will always be a mismatch between the corresponding bipolar transistors. For a mismatch from qn2 and qn3 the collector current of qn3 deviates from its ideal value I1/3 to a new value I1/3+ΔI. For a given I1 current and qp1 and qp3 assumed to have no mismatch a corresponding −ΔI1 current is reflected from the second arm to the first and the third arm. In this scenario the base-emitter voltage of qp2 increases as its collector current increases from I1/3 to I1/3+ΔI, and the base-emitter voltage of qn1 decreases as its collector current decreases from I1/3 to I1/3−ΔI/2. As a result the base-emitter voltage of qp2 increases and the base-emitter voltage of qn1 decrease such that the variation of the total base-emitter voltage is reduced.

In effect each of the arms serves to compensate for variations in the other arising from the mismatch. In other words, a self-compensating circuit is provided.

A similar demonstration can be made for the mismatch of qp1 and qp3.

Another important benefit derived from a circuit such as that shown in FIG. 1 is related to the base current compensation. It will be understood by those of ordinary skill that for a mature bipolar process the complementary bipolar transistors, pnp and npn, have, at a first order approximation, their "beta" factors balanced. With this assumption it can be shown that in a circuit such as shown in FIG. 1, all base currents are compensated: the base current of qp3 is compensated by the base current of qn3; the base current of qp1 is compensated by the base current of qn2; the base current of qp2 (large emitter area) is compensated by the base current of qn1 (large emitter area).

Another important benefit derived from this circuit that generates an output voltage based on differences in base emitter voltages is related to its low output impedance. This is important when the output node is loaded or similar circuits are stacked one on top of the others. If the output impedance of the cell is not negligible then the output voltage is sensitive to load variation. It will be appreciated that a nested amplifier is formed with qp1, qn1, mn1 where mn1 is inside the closed loop. The output impedance of mn1 is reduced by the loop gain factor of this amplifier.

The voltage noise at the output node, especially low band noise (from 0.1 Hz to 10 Hz), is low because:

- the noise injected from the vdd line via the bias current I is greatly attenuated by the ratio of the impedance seen at the common emitter node of qp1, qp2, and qp3

$$\left(\text{in } dc \sim \frac{2}{g_m}\right)$$

to the output impedance of the current mirror generating the bias current I1, usually large;
- mn1 noise is also attenuated as it controls a second order parameter (base-collector voltage) of bipolar transistors, qp2 and qn2;
- qn2, qp3, and qn3 are diode connected devices generating minimum voltage noise;
- all bipolar transistors not connected as diodes have their base nodes connected to low impedance nodes of other bipolar transistors diode connected.

To demonstrate these benefits, a circuit according to FIG. 1 was simulated using silicon proved models. It will be understood that such a simulation is provided to demonstrate the efficacy of a circuit provided in accordance with the present teaching and it not intended to limit the present teaching to the specifics of the simulation. However for the sake of understanding the following details the simulation circuit: bias current I=3 uA (PTAT), emitter area ratio, n=25, mn1 with W=10, L=6.

Figure 2:
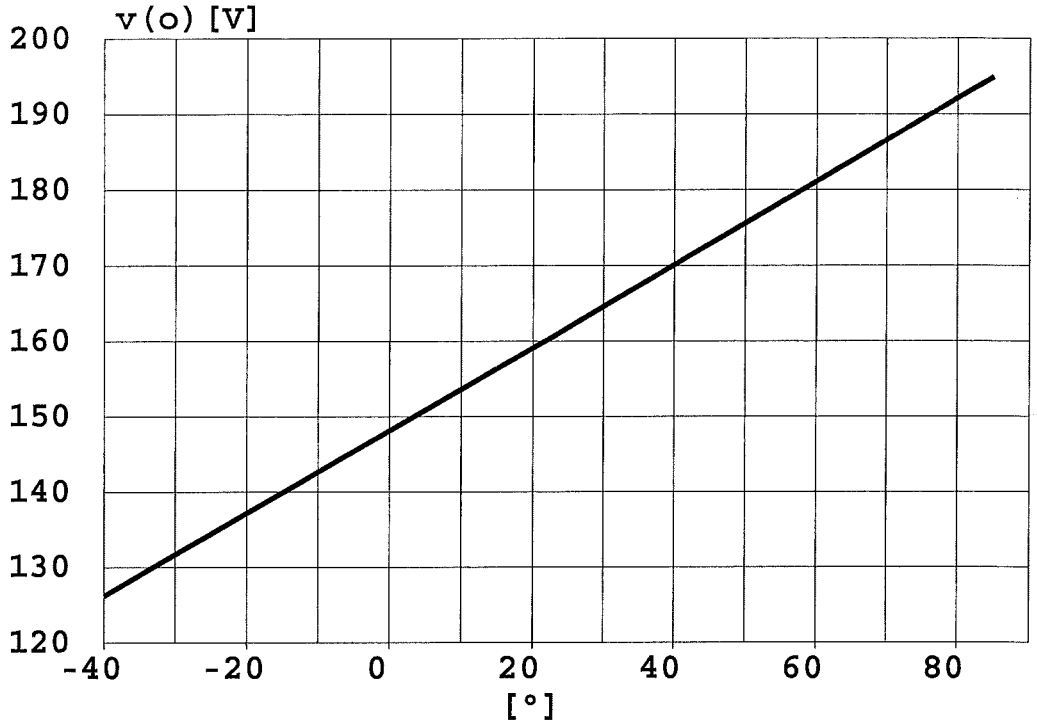
FIG. 2 is a graph showing simulation data of the output PTAT voltage of the circuit of FIG. 1 verses temperature.
Figure 3:
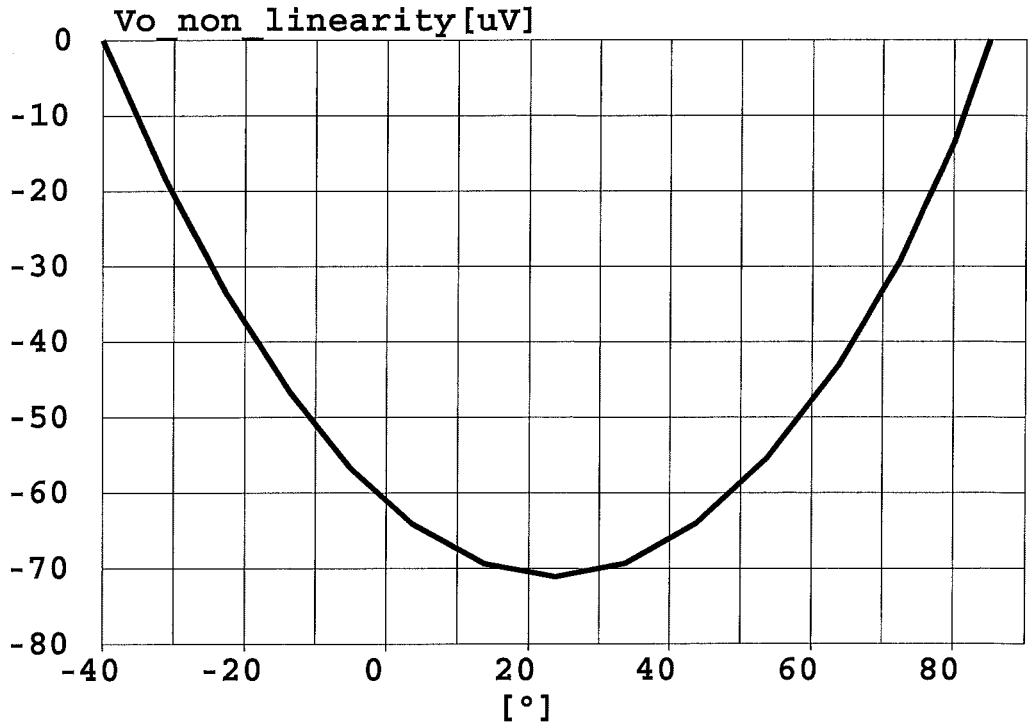
FIG. 3 is a graph showing simulation data of the output PTAT voltage non-linearity of the circuit of FIG. 1 verses temperature.

The output PTAT voltage verse temperature and its nonlinearity for a temperature range from −40° C. to 85° C. are plotted in each of FIGS. 2 and 3. As is evident from an inspection of the data, the output PTAT voltage at 25° C. is ~162 mV and its maximum deviation from the straight line is ~71 μV or 0.01%.

Figure 4:
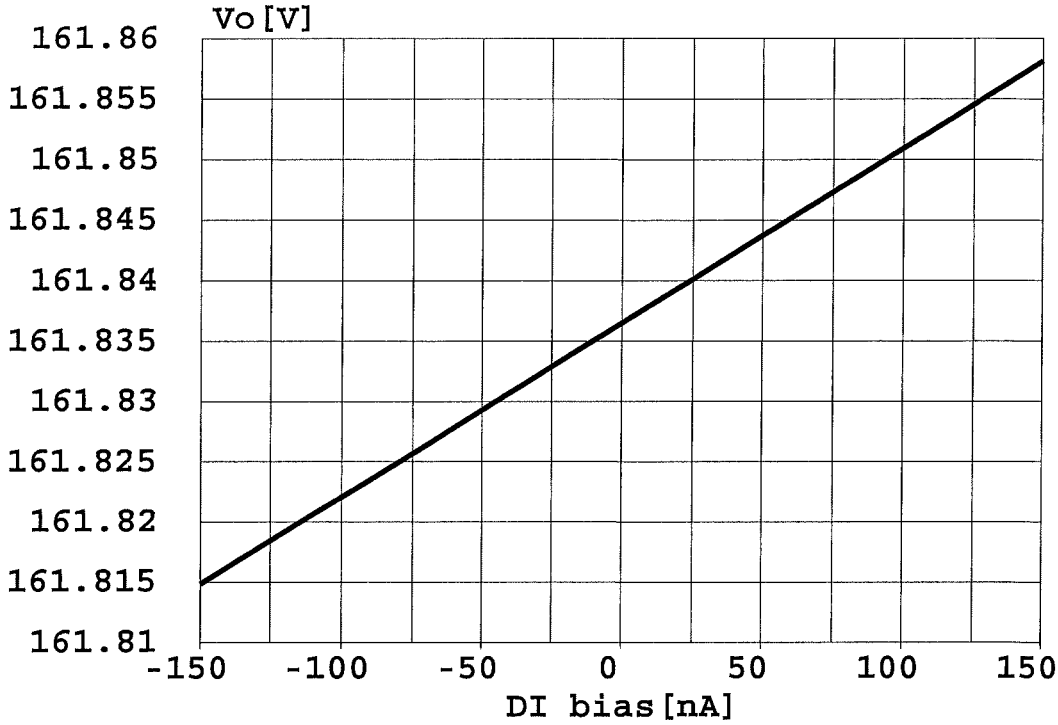
FIG. 4 is a graph showing simulation data of how changes in the biasing current provided to the circuit of FIG. 1 is reflected in changes in the output PTAT voltage.

The output voltage sensitivity to the bias current variation was tested in simulation by altering the bias current with 10%, (+/−0.15 uA). The output voltage variation due the 10% change in bias current is plotted in FIG. 4. As can be seen from FIG. 4 a 10% change in bias currents is reflected as 43 μV change in output voltage which is ~0.026% or negligible.

Figure 5:
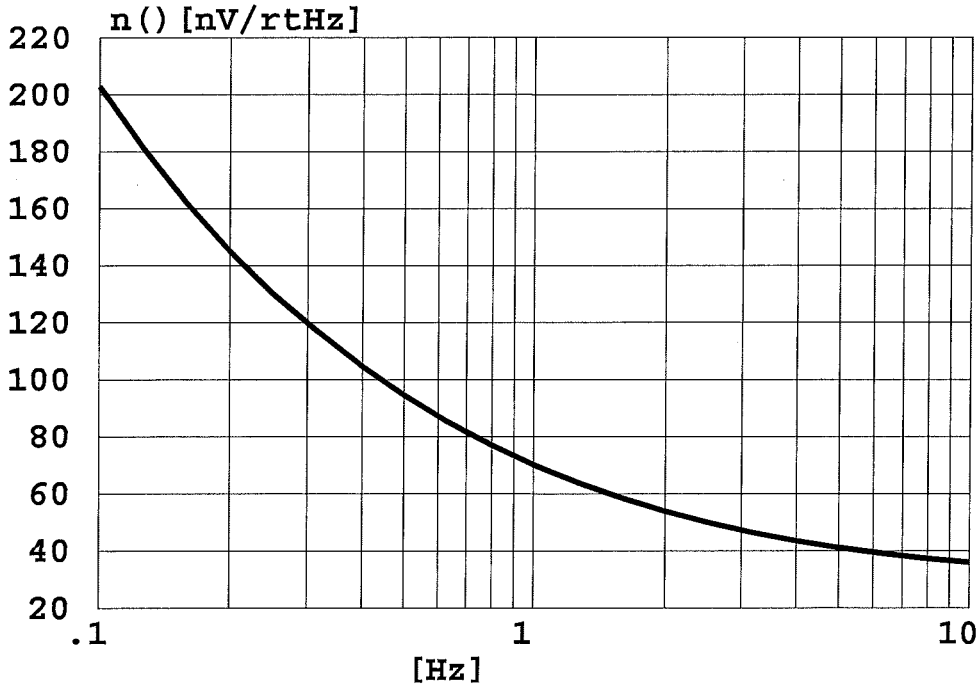
FIG. 5 is a graph showing simulation data of the corresponding noise voltage density $$\left(\text{in}\frac{nV}{\sqrt{\text{Hz}}}\right)$$

Similarly the corresponding noise voltage density $$\left(\text{in } \frac{nV}{\sqrt{\text{Hz}}}\right)$$

at 25° C. from 0.1 Hz to 10 Hz was determined and is plotted in FIG. 5. The integral voltage noise (root mean square, rms, noise) from 0.1 Hz to 10 Hz is plotted in FIG. 6. From an inspection of the simulation data it will be evident that another advantage of a circuit provided in accordance with the present teaching is very high power supply rejection ratio, PSRR, more than 140 db with an ordinary bias current.

FIG. 7 shows an exemplary circuit provided in accordance with the present teaching, which is configured to further reduce errors arising from mismatch in individual components of the circuit. In this configuration, which includes similar components to that already described with reference to FIG. 1, the two diode connected bipolar transistors of the third arm, qp3 and qn3, can be made as an array of "m" similar bipolar transistors; i.e. fabricated from a plurality of individual transistors. In this way mismatches arising from qp3 to qp1 and qn3 to qn2 are reduced but the base-emitter voltage difference from the nodes o1 and o1 remains according to equation (1). As evident from an inspection of the operation of the circuit of FIG. 7 per the operation equation, equation 2 that follows, the base-emitter voltage difference from the nodes o2 to o1 is:

$$\begin{aligned} V_{02,01} &= V_{be}(qp3) - V_{be}(qp2) + V_{be}(qn3) - V_{be}(qn1) \qquad (2) \\ &= \frac{kT}{q}\ln\left(\frac{1}{m} * \frac{m}{1} * n\right) + \frac{kT}{q}\ln\left(\frac{1}{m} * \frac{m}{1} * n\right) \\ &= 2\frac{kT}{q}\ln(n) \end{aligned}$$

FIG. 8 shows an example of another circuit provided in accordance with the present teaching. In this circuit, which is implemented in a full bipolar implementation there is less sensitivity to base-collector voltage variation effect, sometimes known as the Early effect. The Early effect is the variation in the width of the base in a bipolar junction transistor due to a variation in the applied base-collector voltage. As will be known to those of skill in the art, the threshold voltage of MOS transistors have large process variations. In the circuit of FIG. 8, the NMOS transistor, mn1, of FIGS. 1 and 7, across which the base-emitter voltage is developed is replaced with a bipolar equivalent circuit. Here bipolar transistor qp4 act as a follower biased with a small bias current I2 and qn4 and qn5 forms a Darlington pair. It will be appreciated that in such a configuration, the current amplified by the first transistor is amplified further by the second one. As can be seen from an inspection of FIG. 8, the base node of the output transistor qn5 will be close to the collector voltage of qn1 due to the two base-emitter voltages of qp4 and qn4 going in opposite direction; one up (qp4) and one down (qn4).

It will be appreciated that with less sensitivity to base-collector voltage variation effects than the circuit of FIG. 1, that a circuit provided in accordance with the teaching of FIG. 8 will be less sensitive to variations in the bias current I1 as compared to the circuit of FIG. 1. To demonstrate this, a circuit according to FIG. 8 was simulated at ambient temperature with the bias current I1 changed from an initial value to values approximating +/−10% the initial value. The output voltage variation is plotted in FIG. 9 and as can be seen a +/−10% variation of the bias current is reflected as about +/−16 uV in the output voltage. This variation is effectively negligible.

Another example of a circuit that may be provided in accordance with the present teaching is shown in FIG. 10. In this circuit, the bias current I1 of FIG. 1 is replaced by a resistor r1 coupled to a voltage source vdd. One advantage of the circuit of FIG. 10 is that it is self-biased and need no extra bias current and auxiliary start-up circuit. As a result the circuit has a quick time response characteristic and its sensitivity to the bias current variation is even smaller. One reason to select a circuit per the teaching of FIG. 1 over that of FIG. 10 is related to PSSR degradation to about 60 db to 70 db at low frequencies, but for high frequency operations a circuit per the teaching of FIG. 10 can be advantageously employed.

Another example of a PTAT voltage circuit provided in accordance with the present teaching is illustrated in FIG. 11. In this circuit, the implementation is achieved with all npn bipolar transistors.

There are three npn bipolar transistors of unity emitter area, qn3, qn5 and qn6, two npn bipolar transistors having n times unity emitter area, qn1 and qn2, and one transistor having m times unity emitter area, qn4. The collector current of qn5 is mirrored via two PMOS (or bipolar) transistors, mp1 and mp2 to the collector of qn1. A single bias current I1 is again provided and is divided down through qn3 and qn2 based on m factor.

It will be appreciated that for m=1 the collector currents of qn2 and qn3 are very much closed. For m=2 the bias current I1 is divided down in three components with two thirds of the bias current flowing through qn3 and qn4 and one third flowing through qn2 and qn6. As a result of this division of a single bias current into different arms of the circuit, the base-emitter voltage difference from qn3 plus qn4 to qn1 plus qn2 is reflected at the output node, o2, which is the drain terminal of the NMOS transistor mn1. This transistor along with qn1 and mp2 forms a nested amplifier with mn1 inside the closed loop.

A circuit according to FIG. 11, biased with 1 uA PTAT current, and with parameters: unity emitter bipolar transistor of 4 μm×4 μm; n=25; m=2; mp1 and mp2 with aspect ratio W/L=20 μm/30 μm, mn1 with aspect ratio W/L=100 μm/4 μm was simulated. As was described above with reference to the simulation of the circuit of FIG. 1, it is not intended to limit the present teaching to any one set of simulation data.

The output voltage and its non-linearity as derived from the simulation are plotted in FIGS. 12 and 13. As will be seen the temperature sensitivity of the simulated circuit is 192 mV/300V or 0.64 mV/° C.

Different circuit variants can be developed based on the circuit of FIG. 11. When the supply voltage is large enough the number of stacked bipolar transistors can be increased from two to three or any other number. As a result of such stacking it is possible to increase the temperature sensitivity and to reduce the errors. A single cell or a stack of similarly configured cells can be used as a PTAT voltage component of a bandgap type voltage reference. In this way the PTAT circuits described previously can be cascaded to generate higher output PTAT voltages. It will be appreciated that the output voltage of a PTAT cell or a cascaded circuit can be added to a corresponding complimentary to absolute temperature, CTAT, voltage to generate a temperature compensated band-gap type voltage reference with little or no temperature sensitivities.

FIG. 14 shows an example of a circuit provided in accordance with the present teaching comprising CTAT and PTAT components. The circuit comprises a PTAT cell such as those described previously. In addition a CTAT cell is incorporated such that the output of the overall circuit is a combination of the CTAT and PTAT cells. As shown in FIG. 14 the circuit is configured to incorporate a CTAT bias current. The base-emitter voltage of an NPN configured bipolar transistor qn3 is mirrored via an amplifier, A, across a resistor r1. A second NMOS device mn2 is configured to force a CTAT current from the supply line, vdd, and the diode connected PMOS device mp1 through the resistor r1. This current is then mirrored via a second PMOS transistor, mp2, to bias the three arms of the PTAT circuit consisting on qp1, qn1, mn1; qp2, qn2, qp3, qn3. A base-emitter voltage divider is inserted between the base and emitter terminals of bipolar transistor qn1. It will be appreciated that this divider functions to extract a fraction of base-emitter voltage which balances the temperature coefficient of the PTAT voltage developed between the nodes of and ground.

A circuit according to FIG. 14 was simulated with the conditions:

- qp1, qp3, qn2, qn3, unity emitter bipolar transistors;
- qn1, qp2, twenty five unity emitter bipolar transistors;
- resistors having values: r1=55 kohm, r2=550 kohm, r3=184 kohm.

The simulated voltage vs. temperature at the node "o3" is plotted in FIG. 15

It will be appreciated that a circuit such as that described with reference to FIG. 14 can be stacked or cascaded to generate larger output voltages. For example, for a stack of two base-emitter—CTAT—cells and a corresponding base-emitter voltage divider a double reference voltage can be generated. In a similar fashion mode PTAT cells can be stacked and larger reference voltage can be generated.

It will be appreciated that circuits provided in accordance with the present teaching provide a number of advantages including:

- the output voltage, proportional to absolute temperature, is very consistent with reduced variability due to the process change and mismatches;
- low noise;
- self biased with a single resistor;
- high PSRR; and
- very low non-linearity.

It is however not intended to limit the present teaching to any one set of advantages or features as modifications can be made without departing from the spirit and or scope of the present teaching.

The systems, apparatus, and methods of providing a temperature dependent voltage output are described above with reference to certain embodiments. A skilled artisan will, however, appreciate that the principles and advantages of the embodiments can be used for any other systems, apparatus, or methods with a need for a temperature sensitive output.

Additionally, while the base-emitter voltages have been described with reference to the use of specific types of bipolar transistors any other suitable transistor or transistors capable of providing base-emitter voltages could equally be used within the context of the present teaching. It is envisaged that each single described transistor may be implemented as a plurality of transistors the base-emitters of which would be connected in parallel. For example, where circuits in accordance with the present teaching are implemented in a CMOS process, each transistor may be implemented as a plurality of bipolar substrate transistors each of unit area, and the areas of the transistors in each of the arms would be determined by the number of bipolar substrate transistors of unit area connected with their respective base-emitters in parallel.

In general, where the circuits according to the present teaching are implemented in a CMOS process, the transistors will be bipolar substrate transistors, and the collectors of the transistors will be held at ground, although the collectors of the transistors may be held at a reference voltage other than ground.

Such systems, apparatus, and/or methods can be implemented in various electronic devices. Examples of the electronic devices can include, but are not limited to, consumer electronic products, parts of the consumer electronic products, electronic test equipment, wireless communications infrastructure, etc. Examples of the electronic devices can also include circuits of optical networks or other communication networks, and disk driver circuits. The consumer electronic products can include, but are not limited to, measurement instruments, medical devices, wireless devices, a mobile phone (for example, a smart phone), cellular base stations, a telephone, a television, a computer monitor, a computer, a hand-held computer, a tablet computer, a personal digital assistant (PDA), a microwave, a refrigerator, a stereo system, a cassette recorder or player, a DVD player, a CD player, a digital video recorder (DVR), a VCR, an MP3 player, a radio, a camcorder, a camera, a digital camera, a portable memory chip, a washer, a dryer, a washer/dryer, a copier, a facsimile machine, a scanner, a multi-functional peripheral device, a wrist watch, a clock, etc. Further, the electronic device can include unfinished products.

Unless the context clearly requires otherwise, throughout the description and the claims, the words "comprise," "comprising," "include," "including," and the like are to be construed in an inclusive sense, as opposed to an exclusive or exhaustive sense; that is to say, in the sense of "including, but not limited to." The words "coupled" or "connected", as generally used herein, refer to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words using the singular or plural number may also include the plural or singular number, respectively. The words "or" in reference to a list of two or more items, is intended to cover all of the following interpretations of the word: any of the items in the list, all of the items in the list, and any combination of the items in the list. All numerical values provided herein are intended to include similar values within a measurement error.

The teachings of the inventions provided herein can be applied to other systems, not necessarily the circuits described above. The elements and acts of the various embodiments described above can be combined to provide further embodiments. The act of the methods discussed herein can be performed in any order as appropriate. Moreover, the acts of the methods discussed herein can be performed serially or in parallel, as appropriate.

While certain embodiments of the inventions have been described, these embodiments have been presented by way of example only, and are not intended to limit the scope of the disclosure. Indeed, the novel methods and circuits described herein may be embodied in a variety of other forms. Furthermore, various omissions, substitutions and changes in the form of the methods and circuits described herein may be made without departing from the spirit of the disclosure. The accompanying claims and their equivalents are intended to cover such forms or modifications as would fall within the scope and spirit of the disclosure. Accordingly, the scope of the present inventions is defined by reference to the claims.

What is claimed is:

1. A proportional to absolute temperature, PTAT, circuit, the circuit comprising:

a bias current;

a plurality of bipolar transistors arranged in first, second and third arms of the circuit and configured to generate a proportional to absolute temperature voltage at an output of the circuit that is dependent on individual ones of the plurality of bipolar transistors, wherein:

each of the arms includes a bipolar transistor that corresponds to a bipolar transistor of another one of the arms, each of the first arm, second arm and third arms are coupled to the same bias current such that the bias current is divided into respective currents flowing through each of the arms, and the bipolar transistors are configured such that each of the arms compensates for current variations in the currents flowing through the other arms, the variations caused by mismatches between the corresponding bipolar transistors.

2. The circuit of claim 1 wherein the proportional to absolute temperature voltage provided at the output is related to a base-emitter voltage difference generated from an emitter ratio of a first set of bipolar transistors operating at a first collector current density and a second set of bipolar transistors operating at a second, lower, collector current density.

3. The circuit of claim 2 comprising an amplifier and wherein the base-emitter voltage difference generated from the emitter area ratio is reflected across the amplifier to the output.

4. The circuit of claim 1 wherein each arm comprises at least one transistor provided in a PNP configuration, the circuit being configured such that emitters of individual PNP transistors of each of the first, second and third arms are coupled to a common node that is biased by the bias current.

5. The circuit of claim 4 wherein a first arm of the circuit comprises a PNP transistor having a unity emitter size and a second arm of the circuit comprises a PNP transistor having a multiple, n, emitter size, the circuit being configured to generate a voltage at the output that is first order independent of the bias current and proportional to the multiple n.

6. The circuit of claim 4 comprising a plurality of bipolar transistors configured in an NPN configuration and wherein each of a first arm and a second arm of the circuit comprises at least one NPN configured transistor and at least one PNP configured transistor, the first arm operating at a first collector current density and the second arm operating at a second, lower, collector current density, the circuit being configured to generate a base emitter voltage difference at the output of the circuit.

7. The circuit of claim 6 wherein the NPN configured transistors have a different emitter area to the PNP configured transistors.

8. The circuit of claim 1 wherein the bias current is provided by a current source coupled to a supply voltage of the circuit.

9. The circuit of claim 1 wherein the bias current is provided by coupling a supply voltage of the circuit to an impedance element, the voltage provided by the supply voltage being reflected across the impedance element to form the bias current.

10. The circuit of claim 3, wherein the amplifier is a MOS device, and wherein individual ones of the bipolar transistors and the MOS device provide a nested amplifier, the MOS device having an output impedance that is reduced by a loop gain factor of the amplifier.

11. The circuit of claim 1 wherein the bipolar transistors are all provided in a NPN configuration.

12. The circuit of claim 1 wherein individual transistors of the third arm are provided in a diode connected configuration.

13. The circuit of claim 12 wherein the diode connected transistors of the third arm are provided as an array of similar transistors.

14. The circuit of claim 1 wherein individual transistors are arranged in a Darlington pair configuration such that current amplified by a first transistor is further amplified by a second transistor.

15. A proportional to absolute temperature, PTAT, source comprising a plurality of circuits as claimed in claim 1 cascaded relative to one another to generate a higher output voltage than available from individual ones of the plurality of circuits.

16. The circuit of claim 1, wherein the bias current is divided equally between the first, second and third arms when the corresponding bipolar transistors are matched, and wherein the bipolar transistors are interconnected such that the equal division of the bias current is maintained when the corresponding bipolar transistors are mismatched, thereby reducing a mismatch induced variation in the proportional to absolute temperature voltage.

17. A voltage reference circuit comprising:

a proportional to absolute temperature, PTAT, circuit, the PTAT circuit comprising a bias current, and a plurality of bipolar transistors arranged in first, second and third arms of the circuit and configured to generate a proportional to absolute temperature voltage at an output of the PTAT circuit that is dependent on individual ones of the plurality of bipolar transistors, wherein each of the first arm, second arm and third arms are coupled to the same bias current such that the bias current is divided into each of the arms and each of the arms compensates for bias current variations in the other of the arms;

a complimentary to absolute temperature, CTAT, circuit, the CTAT circuit configured to generate a complimentary to absolute temperature voltage at an output of the CTAT circuit; and wherein the PTAT circuit and the CTAT circuit are coupled to one another to compensate for temperature variations in response characteristics of the other of the CTAT circuit and temperature circuit.

18. A method of providing a proportional to absolute temperature, PTAT, voltage, the method comprising:

providing a circuit comprising a plurality of bipolar transistors arranged in first, second and third arms of the circuit, wherein each of the arms includes a bipolar transistor that corresponds to a bipolar transistor of another one of the arms;

coupling each of the first arm, second arm and third arms to a single bias current such that the bias current is divided into respective currents flowing through each of the arms;

configuring the bipolar transistors to generate a proportional to absolute temperature voltage at an output of the circuit that is dependent on individual ones of the plurality of bipolar transistors; and configuring the bipolar transistors such that the current flowing through each of the arms compensates for variations in the currents flowing through the other arms, the variations caused by mismatches between the corresponding bipolar transistors.

19. The method of claim 18 comprising generating a base-emitter voltage difference between a first set of bipolar transistors operating at a first collector current density and a second set of bipolar transistors operating at a second, lower, collector current density, the base emitter voltage difference having a PTAT dependence.

20. The method of claim 19 comprising providing a MOS device and reflecting the base-emitter voltage difference across the MOS device to the output of the circuit.

21. The method of claim 18 comprising providing in each arm at least one transistor provided in a PNP configuration, emitters of individual PNP transistors of each of the first, second and third arms being coupled to a common node that is biased by the same bias current, a first arm of the circuit comprising a PNP transistor having a unity emitter size and a second arm of the circuit comprising a PNP transistor having a multiple, n, emitter size, the method further comprising generating a voltage at the output that is first order independent of the bias current and proportional to the multiple n.

22. The method of claim 18, further comprising:

configuring the bipolar transistors such that the bias current is divided equally between the first, second and third arms when the corresponding bipolar transistors are matched, wherein the configuring of the bipolar transistors such that the current flowing through each of the arms compensates for variations in the currents flowing through the other arms includes interconnecting the bipolar transistors such that the equal division of the bias current is maintained when the corresponding bipolar transistors are mismatched, thereby reducing a mismatch induced variation in the proportional to absolute temperature voltage.

* * * * *